United States Patent [19]

D'Ambrosio

[11] Patent Number: 4,549,317

[45] Date of Patent: Oct. 29, 1985

[54] GARMENT WAISTBAND CONSTRUCTION

[76] Inventor: Anthony H. D'Ambrosio, 10th St. and Godfrey Ave., Philadelphia, Pa. 19126

[21] Appl. No.: 465,472

[22] Filed: Feb. 10, 1983

[51] Int. Cl.[4] ..... A41F 9/02

[52] U.S. Cl. ..... 2/237

[58] Field of Search ..... 2/237, 221, 76, 236, 2/220

[56] References Cited

U.S. PATENT DOCUMENTS

| | | | |
|---|---|---|---|
| 2,667,643 | 2/1954 | Elman | 2/236 |
| 2,708,274 | 5/1955 | Vander et al. | 2/237 |
| 2,718,011 | 9/1955 | Caruso | 2/236 |
| 3,155,986 | 11/1964 | Miller | 2/236 |
| 3,427,661 | 2/1969 | Navasky | 2/236 |
| 3,723,993 | 4/1973 | Ruby | 2/237 |
| 3,848,268 | 11/1974 | D'Ambrosio | 2/237 |
| 4,332,034 | 6/1982 | Muse | 2/237 |

*Primary Examiner*—H. Hampton Hunter

*Attorney, Agent, or Firm*—Woodcock Washburn Kurtz Mackiewicz & Norris

[57] ABSTRACT

An improved waistband construction for garments is disclosed which features an elastic inner band, the entire width of which is exposed to any other garment worn simultaneously, so as to insure that the garment having the waistband according to the invention and the other garment remain in relative alignment. "Fullness" is built into the shell of the garment, whereby the shell may be of any desired material, while permitting the stretchable waistband, without unsightly bulging.

8 Claims, 5 Drawing Figures

GARMENT WAISTBAND CONSTRUCTION

FIELD OF THE INVENTION

This invention relates to the manufacture of garments. More particularly, the invention relates to an improved waistband construction for garments whereby a single garment may be so manufactured as to properly fit persons varying over several standard sizes.

BACKGROUND OF THE INVENTION

The prior art recognizes that it would be desirable to provide garments which do not require alteration of the waist structure in order to accommodate persons of several sizes. See, for example, my previous U.S. Pat. No. 3,848,268 in which I disclose and claim a garment having an improved waistband construction by which a single gven garment usually fits persons having waist sizes in the range of three standard sizes. In this way, for example, a pair of pants having a nominal 36 inch waist will fit those with waists between 35 and 37 inches. Numerous advantages are provided by this construction, including reduction of the inventory needed to be carried by a merchant, simplification of manufacturing operations, elimination of much tailoring operations, and significant savings of time to garment purchasers, as waistband alterations are eliminated. The waistband shown in my previous patent also had the quality that it tended to grip other garments worn, such as a man's shirt.

The construction shown in my previous patent has enjoyed substantial success but there is always room for improvement. In this particular case, I found that the manufacturing operation could be simplified. I also have discovered that it would be desirable to design a waistband providing improved adhesion to other garments worn; for example, improved adherence of a man's shirt to the waistband ensures that his trousers stay up while his shirttail stays tucked in. Perhaps most importantly, my previous construction also required the use of stretchable knit fabric for the visible portion or "shell" of the trousers or other garment made using the waistband of my invention; for reasons of aesthetics, more versatility in material choice would be desirable.

OBJECTS OF THE INVENTION

Accordingly, it is an object of the invention to provide an improved waistband for trousers which accommodate persons of varying sizes without causing unsightly bulges, folds, wrinkles, or the like.

It is further an object of the invention to provide an improved waistband for a garment such that the garment and another garment worn simultaneously tend to maintain their relative positions thereby further maintaining the neat appearance of the wearer.

It is another object of the invention to provide a multiple-size waistband which can be used with all sorts of non-stretchable materials.

SUMMARY OF THE INVENTION

The above needs of the art and objects of the invention are satisfied by the present invention which comprises a garment waistband construction in which the outer shell of the garment may be of any desired fabric, including fabrics which do not stretch. An inner waistband portion comprises an elastic material such as a Lycra Spandex material which has its entire width exposed to the interior of the garment so that it comes into contact with any other garments worn. This material is relatively adhesive and so the desired result of maintaining the relative positions of the garment according to the invention and another garment, such as a shirt, is achieved. In the particularly preferred embodiment, the lower edge of the elastic band is not sewn to the other parts of the waistband so that an upward force exerted thereon tends to force it into a closer, more firmly binding engagement with the other garment being worn, so as to further maintain their relative positions. The elastic may be woven in two different weaving patterns, or in a single weaving pattern.

BRIEF DESCRIPTION OF THE DRAWINGS

The invention will be better understood if reference is made to the accompanying drawings in which.

DESCRIPTION OF THE PREFERRED EMBODIMENT

As mentioned above, the invention in this case is an outgrowth of work previously resulting in my U.S. Pat. No. 3,848,268 and the description here will largely be limited to discussion of the differences between the waistband construction shown here and that shown in my earlier patent, the disclosure of which is incorporated herein by reference. Accordingly, where a specific constructional detail is not specified herein it may in general be assumed that the construction is unchanged from that previously shown.

Figure 1:
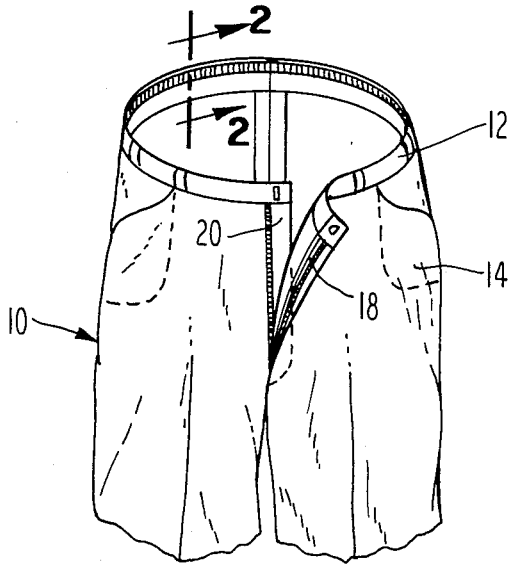
FIG. 1 shows an overall view of trousers constructed with the waistband according to the invention.

Thus, as discussed in my earlier patent, with reference to FIG. 1 herein as well, the pair of slacks 10 is shown having a waistband 12 attached to the garment shell 14. In accordance with modern styling practices, the waistband shell 12 and the lower shell 14 are of the same material. However, unlike the construction of my previous patent, in which this fabric had to be a relatively stretchable material, in accordance with the teachings herein this fabric may be any desired material. At the front of the slacks the fly portion comprises a black fly portion 18 and the mating white fly portion 20. Pockets may also be provided as shown. It should also be appreciated that the waistband construction of the present invention is useful for garments other than trousers, such as ladies' skirts, children's trousers, and the like; and moreover that the fly need not necessarily be provided.

Figure 3:
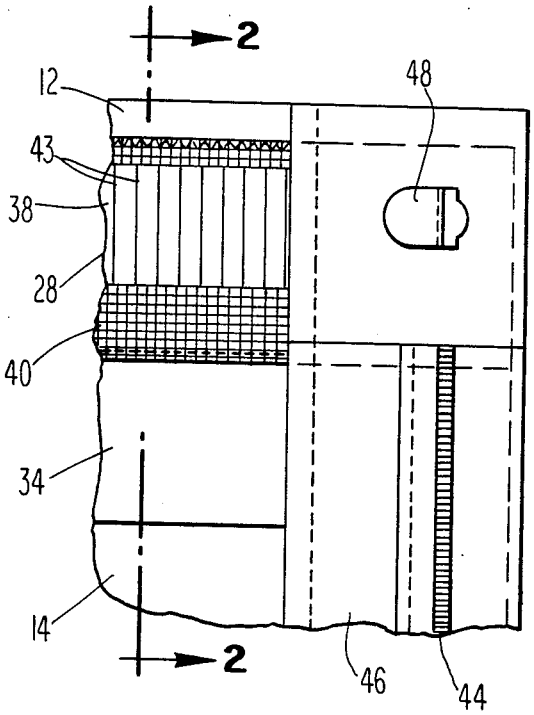
FIG. 3 shows the construction of the so-called "black fly" portion of the trousers as seen from the inside.
Figure 2:
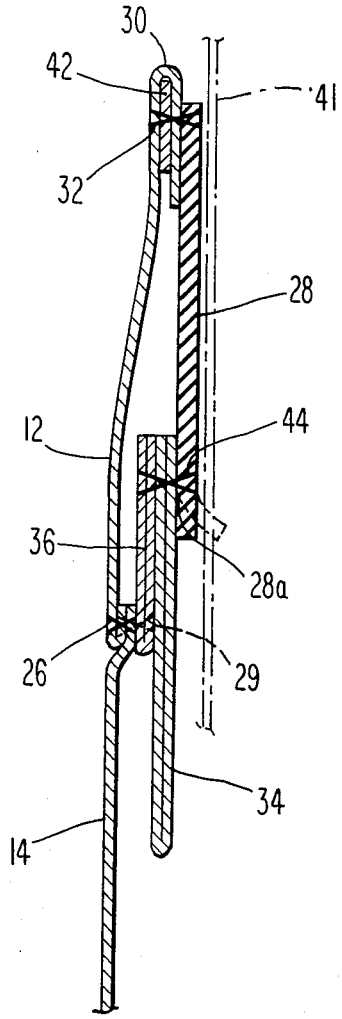
FIG. 2 is a cross-sectional line showing the construction of the waistband, taken along the lines 2—2 of FIG. 1 and of FIG. 3.

FIG. 2 is a cross section taken along the lines 2—2 of FIG. 1 and of FIG. 3. There the waistband portion 12 is shown stitched to the shell portion 14 by a switch 26 which desirably is of a stretchable thread, inasmuch as the waistband 12 and shell 14 stretch.

The waistband 12 stretches because it is cut on the bias, i.e., the warp and woof are inclined with respect to the horizontal, preferably at about 45°. However, bias construction of the shell 14 would be highly undesirable. I have found that if the shell is made with a small degree of "fullness" the warp and woof can be vertically aligned, while permitting the waistband to accommodate persons of several sizes in comfort, without unsightly bulging, and while allowing the waistband 12 and shell 14 to be made of any desired material, even such non-stretchable fabrics are corduroy. This is in clear contrast to my previous patent in which both waistband and shell were of stretchable knit material. I find that by building in several spaced "fullnesses", i.e., extra curtain material defined by double-over gathers of additional material in the shell 14, which may be concealed beneath the waistband, comfort, good appearance and stretchability are achieved while the selection of fabrics is not limited to knit materials. This is more fully discussed in connection with FIG. 5 below.

Attached to the waistband 12 is an elastic strip 28 which is attached to a U-shaped bight 30, formed by folding over the upper edge of the waistband 12, by stitching thereto at 32. For this stitch 32 a cotton-polystretch thread is preferred. Attached to the lower portion of the elastic strip 28 are a long skirt or curtain 34 and a shorter skirt or curtain 36. These hang generally free from the elastic 28 around the periphery of the garment, but they are desirably tacked to the seam 26 joining the waistband 12 and the shell 14 at one or more, e.g. six, locations around the garment as shown by dotted lines 29. As shown, both skirts 34 and 36 are doubled over for extra thickness. Desirably the skirts 34 and 36 are formed of a cotton material cut on the bias to increase their stretchability. The curtains 34 and 36 are attached to the elastic strip 28 by means of a stitch 44, for which polyester stretch thread should be used. Also shown in FIG. 2 is a top strip 42 which may be of a rubberized material to lend extra rigidity to the construction according to the invention.

One point particularly to be mentioned is to note that the lower edge 28*a* of the elastic band 28 is not stitched directly to the skirts 34 and 36 but is left free. This is done so that when a skirt or other garment shown in phantom at 41 is pulled upwardly, the lower tip 28*a* of the waistband 28 is deformed inwardly as shown in phantom so as to be further forced into engagement with the skirt 41, thus further tending to hold the trousers up and keep the shirttail in as discussed above.

Figure 4:
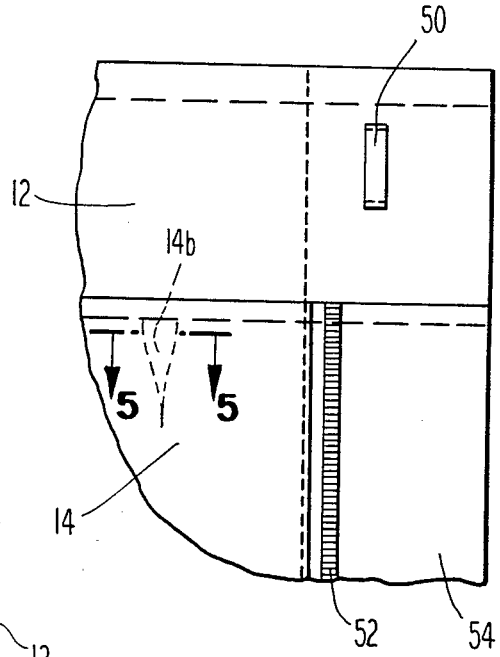
FIG. 4 shows a view of the "white fly" portion of the trousers, seen from the outside.
Figure 5:
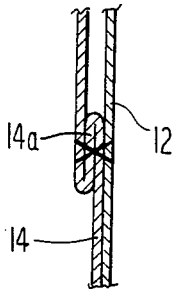
FIG. 5 shows a cross-sectional view along the line 5—5 of FIG. 4.

FIG. 5 is a cross-sectional view of one of the gathers 14*a* formed in the shell 14 to lend it fullness, so that the shell 14 may have some "give" allowing it to be sewn to a stretchable waistband 12. (As noted, while the waistband 12 is formed of the same material as the shell 14, it is cut on the bias, which allows stretching. Bias-cutting of the shell 14 would be undesirable.) The gathers 14*a* generally comprise a folding-over of a tapered section 14*b* of the material of shell 14, as shown in phantom in FIG. 4. The tapered shape 14*b* allows the gather to provide some "give" without giving the unsightly bulging effect which would occur if, for example, a pleat were used. Several such gathers are incorporated; the total material gathered thereby should be $\frac{1}{2}''$–$\frac{3}{4}''$ around each half of the waistband. The gathers should be spaced around the circumference of the shell, e.g., so that the lower apex of the tapered shape 14*b* of each gather coincides with the seat and side seams. In this way the gathers are completely concealed. Use of the gathers yields fullness commensurate with the stretching nature of the waistband.

FIG. 3 shows that the elastic strip 28 comprises two portions, a top section 38 comprised of a series of reinforced vertical fabric members 43 while the lower portion 40 is a cross weave of elastic filaments, all as discussed in my previous patent. Alternatively, a single type of weave may be used. The elastomer used in the elastic strip may be Lycra Spandex. The design of this section of the waistband is intended to provide transverse support so that the fabric does not tend to roll outwardly or bulge, which would lend an unsightly appearance to the garment.

The remainder of the black fly construction shown in FIG. 3 does not depart substantially from the construction shown in my previous patent. A zipper 44 is provided and this is attached to a fabric reinforcement portion interior of flap 46, to guard against buckling. This fabric also supports the clip 48 which interacts with a receiving member 50 attached to the white fly portion shown at FIG. 4. Again, in FIG. 4 the other half of the zipper is shown at 52. This too is attached to a reinforcing section 54 to guarantee against unsightly bulging.

As discussed in connection with FIG. 7 of my previous patent, the header strip 42 shown in FIG. 2 is used to give the waistband 12 more stability and to prevent the elastic strip from riding up above the waistband 12 thus creating an unsightly effect. As can be seen in FIG. 2, the waistband 12 comprises a folded-over bight portion 30 as previously described. The header 42 is inserted in the bight 30 formed in the waistband 12 and is secured by stitching 32. Desirably a "Rokap" or cross zigzag stitch is preferred for this stitch 32, which stitches the very top of the elastic strip 28 to the bight 30 and the header strip 42 as well as to the waistband portion 12. The header material 42 should be a relatively stretchable material so that it will not retard the elasticity of the waistband assembly, preventing its proper function. For example, the material of strip 42 may be a rubberized material or a non-woven or woven material such as canvas cut on the bias to provide stretchability. The waistband 12 may additionally be stiffened with a strip of an adhesive-fused backing material (not shown), which may be woven or non-woven.

As noted above, the waistband 12 is only tacked to the curtains 34 and 36 by stitching 29 at several points around the circumference of the seam 26 connecting the waistband 12 to the shell 14. This provides several advantages as opposed to a continuous stitch. One is that an inside blind stitch is eliminated. Moreover, the construction described allows full freedom of movement without binding or wrinkling of the shell fabric. Similarly, the outside tacking at the waistband seams holds the waistband shell in place, without twisting or wrinkling and permitting the wearer to be active in comfort.

The construction according to the invention also provides for easier manufacture than that found in my previous patent, inasmuch as the curtains 34 and 36 can be assembled to the elastic 28 separately. The backing (not shown) mentioned above is fused to the inside of the waistband 12; for example, it may be ironed on if the appropriate adhesive is used. The bight 30 of the waistband 12 is then formed with stiffening strip 42 therebetween, and the whole attached to the curtains and elastic by stitch 32 in a single operation. This eliminates an intermediate pressing operation which was required by my previous construction methods. In my previous construction, I formed both curtains 34 and 36 from a single piece of material. Use of two separate pieces, stitched together by stitch 44 eliminates another pressing operation. Thereafter the tacks 29 discussed above can be added to secure the curtains 36 and 34 to the waistband/shell seam 26. Similar economies in manufacture are realized in both black and white fly designs as the elastic 26 is simply continued to the end of the fly portion, a flap formed of the waistband and shell is then folded over and stitched down.

While as noted above, the waistband construction of the invention has been described with reference to men's trousers, it is to be understood that it has applicability to construction of other sorts of garments, such as girls, ladies and children's trousers, ladies' skirts and the like. It will also be appreciated as mentioned above that details of the construction of the waistband according to the invention not specifically discussed herein may be presumed to be substantially as discussed in my previous patent, particularly with respect to FIGS. 4 and 6 thereof. Accordingly, the above description of the invention should be considered as exemplary only and not as delimiting its scope, which is more properly defined by the following claims.

I claim:

1. A waistband assembly for a garment comprising a waistband of a fabric material turned over at its upper extremity to form a bight with a small inner flap depending therefrom, an elastic strip of one piece construction having an upper portion which is longitudinally elastic including means substantially preventing transverse bending of said upper portion whereby to exhibit no roll characteristics, said upper portion being positioned adjacent to and sewn to the side of said inner flap, facing inwardly to the wearer away from said waistband at the top of said strip, and a curtain depending from the lower portion of said elastic strip and sewn thereto on the side of said elastic strip facing outwardly towards said outer garment, whereby the entire width of said elastic band is exposed to a garment worn simultaneously with a garment comprising said waistband assembly.

2. The assembly of claim 1 wherein said waistband portion, said bight portion and said elastic strip are joined together by Rokap stitching.

3. The assembly of claim 1 wherein a strip of a relatively thin stretchable material is inserted in said bight portion to further stiffen said waistband assembly.

4. A waistband construction for clothing comprising a shell portion and a waistband portion, wherein the exposed fabric of the shell portion and waistband portion may be of any desired fabric material, comprising:

a waistband portion of said fabric material, cut on the bias;

an elastic band inside said waistband portion and joined thereto at the upper edge of both; and a shell portion of said fabric joined to the lower edge of said waistband portion;

wherein said shell portion has formed therein several gathers, said gathers being concealed beneath said waistband portion, so that said shell portion exhibits fullness, whereby a garment incorporating said waistband construction can accommodate persons of several sizes.

5. The waistband construction of claim 1 wherein said waistband portion is turned over at its top to form a U-shaped bight portion to which said elastic band is stitched, and said bight portion has a strip of stiffening elastic material therein.

6. The construction of claim 5 wherein said stitch is a Rokap stitch.

7. The construction of claim 6 further comprising one or more fabric curtains, depending from said elastic material, and affixed thereto such that the full width of said elastic is exposed to the inside thereof.

8. The construction of claim 6 wherein the lowermost edge of said elastic is not attached to said curtain and forms a lip depending therefrom.

* * * * *